US007147177B2

(12) United States Patent
Yen

(10) Patent No.: US 7,147,177 B2
(45) Date of Patent: Dec. 12, 2006

(54) CABLE REEL

(76) Inventor: Hsu-Li Yen, 3F-2, No. 13, Wu Chuan 1 Rd., Hsin Chuang City, Taipei Hsien (TW)

( * ) Notice: Subject to any disclaimer, the term of this patent is extended or adjusted under 35 U.S.C. 154(b) by 143 days.

(21) Appl. No.: 10/956,062

(22) Filed: Oct. 4, 2004

(65) Prior Publication Data

US 2006/0071112 A1 Apr. 6, 2006

(51) Int. Cl.
*B65H 75/30* (2006.01)

(52) U.S. Cl. ..... 242/385.4; 242/396.2; 242/378.1

(58) Field of Classification Search ..... 242/378, 242/378.1, 378.4, 388.1, 388.6, 385.4, 396.1, 242/396.2; 191/12.2 R
See application file for complete search history.

(56) References Cited

U.S. PATENT DOCUMENTS 996,476 A * 6/1911 Fitton et al. ..... 242/381.3
1,945,842 A * 2/1934 Witchger ..... 33/767
2,129,582 A * 9/1938 Johansson ..... 33/555.4
4,202,510 A * 5/1980 Stanish ..... 242/384.7
5,014,437 A * 5/1991 Sun ..... 33/414
5,178,619 A * 1/1993 Galazaka ..... 606/41
6,866,218 B1 * 3/2005 Liao ..... 242/378.1
6,997,410 B1 * 2/2006 Huang ..... 242/378.3
2002/0170999 A1 * 11/2002 Liao ..... 242/373

* cited by examiner

*Primary Examiner*—Kathy Matecki
*Assistant Examiner*—Sang Kim
(74) *Attorney, Agent, or Firm*—Rosenberg, Klein & Lee

(57) ABSTRACT

A cable reel having a one-way locking mechanism for locking a cable winding hub in one direction so that the user can adjust the extending status of the cables freely, and a button for unlocking the one-way locking mechanism for enabling the cable winding hub to receive the cables by means of the spiral spring force of a spiral spring.

1 Claim, 3 Drawing Sheets

CABLE REEL

BACKGROUND OF THE INVENTION

1. Field of the Invention

The present invention relates generally to a cable reel and more particularly, to an improved structure of cable reel, which enables the user to freely adjust the extending status of the cables and to quickly receive the cables after each use.

2. Description of the Related Art

A variety of cable reels are commercially available for receiving computer cables, electric appliance cables, and communication apparatus cables. By means of a cable reel, the user can adjust the length of the cable conveniently. FIG. 1 shows a cable according to the prior art. According to this design, the cable reel 10 has a winding mechanism (not shown) that automatically receives the cables 101. This structure of cable reel 10 is still not satisfactory in function. When pulling the cables 101 out of the cable reel 10, the user cannot lock the cables 101 to the housing of the cable reel 10 at the desired length, i.e., the user cannot adjust the extended status of the cables 101 freely.

Therefore, it is desirable to provide a cable reel that eliminates the aforesaid drawback.

SUMMARY OF THE INVENTION

The present invention has been accomplished under the circumstances in view. It is the main object of the present invention to provide a cable reel, which enables the user to freely adjust the extending status of the cables and to quickly receive the cables after each use. According to the present invention, the cable reel has a one-way locking mechanism for locking a cable winding hub in one direction so that the user can adjust the extending status of the cables freely, and a button for unlocking the one-way locking mechanism for enabling the cable winding hub to receive the cables by means of the spiral spring force of a spiral spring.

DETAILED DESCRIPTION OF THE INVENTION

Figure 1:
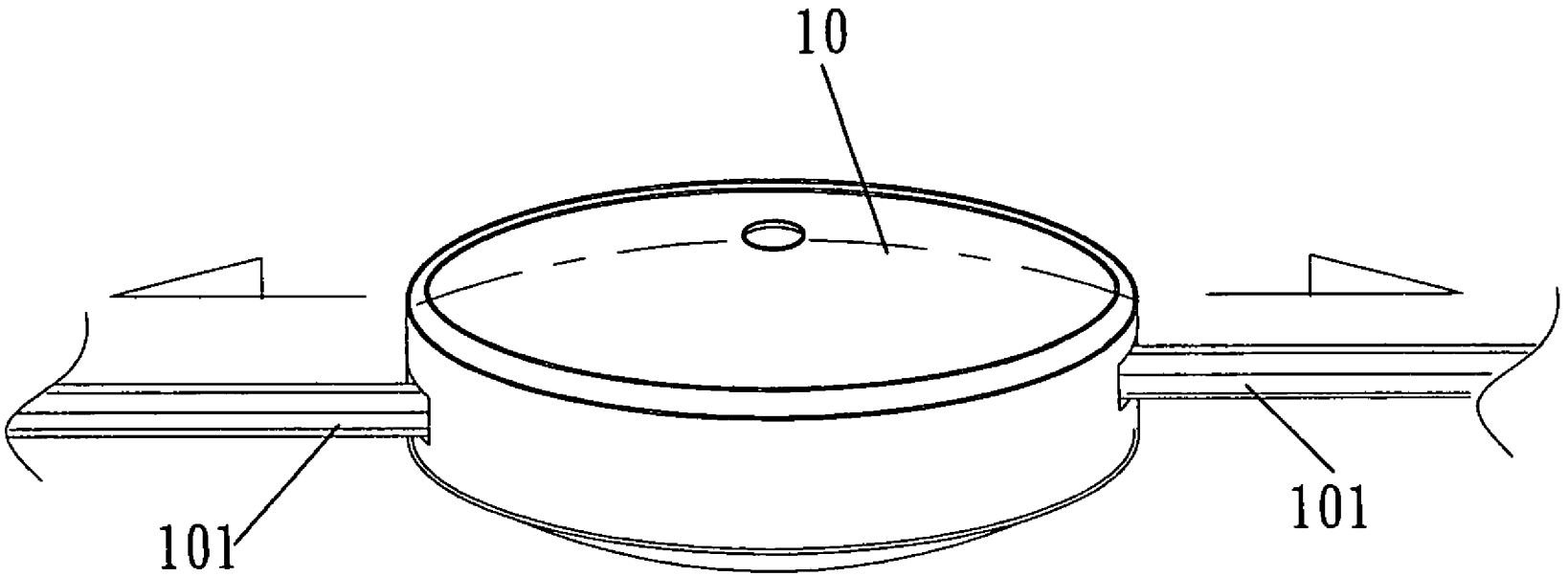
FIG.1 (PRIOR ART)
FIG. 1 is a schematic drawing of a cable reel according to the prior art.
Figure 2:
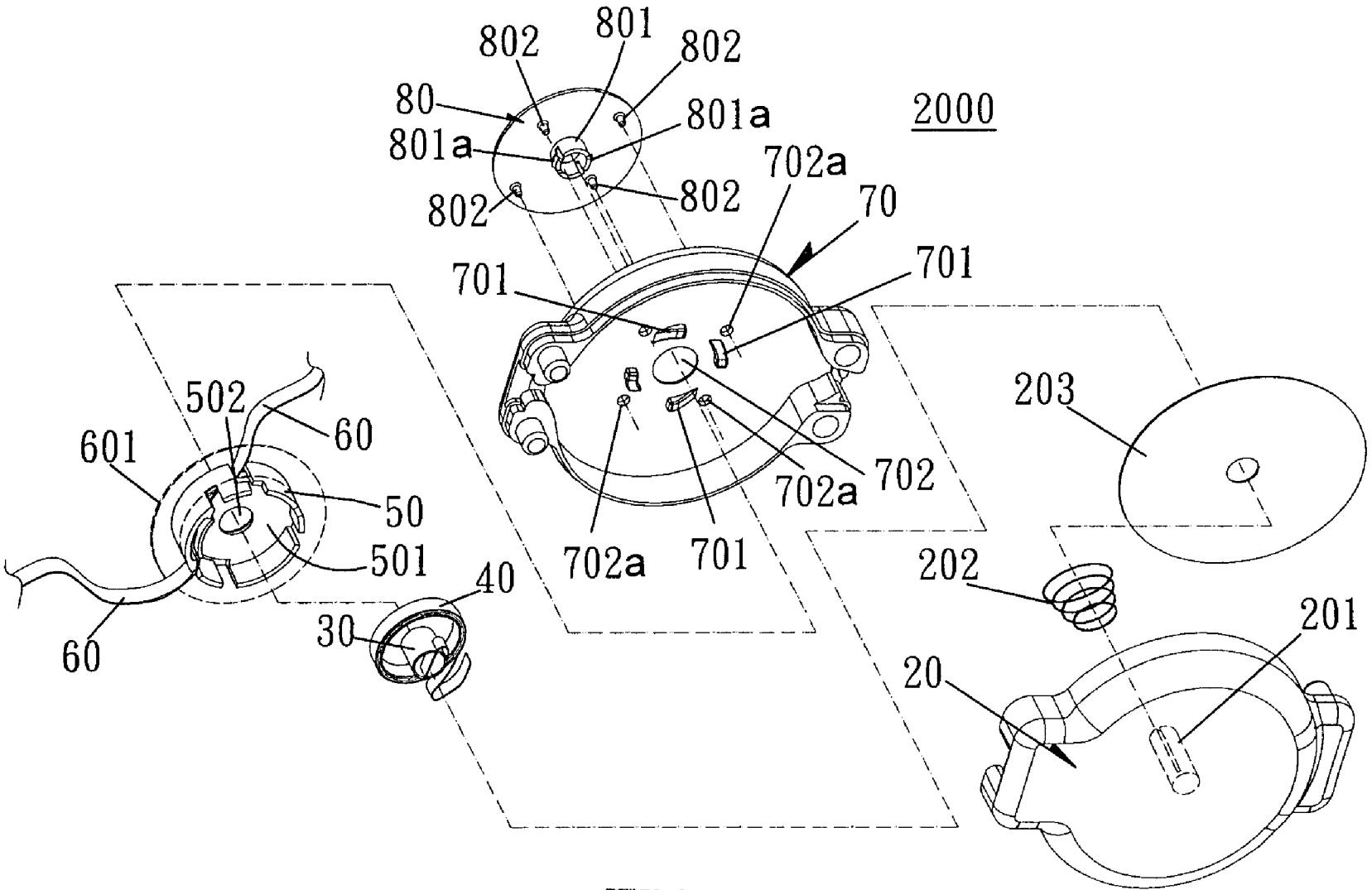
FIG. 2 is an exploded view of a cable reel according to the present invention.
Figure 3:
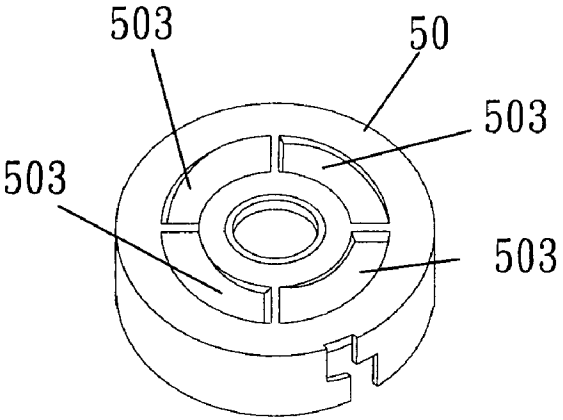
FIG. 3 is an oblique elevation of the winding hub according to the present invention.
Figure 4:
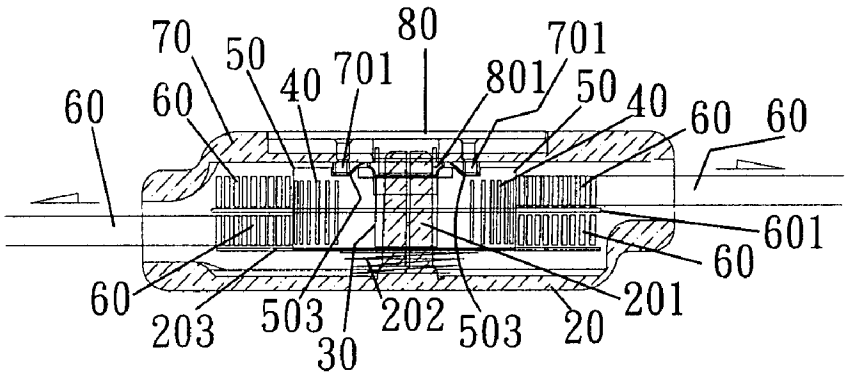
FIG. 4 is a schematic sectional view of the cable reel according to the present invention.

Referring to FIGS. 2~4, a cable reel 2000 is shown comprising a bottom cover shell 20, a tubular shaft 30, a spiral spring 40, a winding hub 50, two cables 60, a top cover shell 70, and a button 80.

The bottom cover shell 20 comprises a center rod 201, which holds a conical spring 202 and a bearing plate 203 on the conical spring 202. The tubular shaft 30 is sleeved onto the center rod 201 of the bottom cover shell 20 and supported on the bearing plate 203 against the conical spring

202. The winding hub 50 has a bottom open chamber 501, which receives the tubular shaft 30, a center through hole 502, which is coupled to the center rod 201 of the bottom cover shell 20, a flange 601 fastened to the periphery of one end thereof, and a plurality of top locating holes 503 equiangularly spaced around the center through hole 502. The spiral spring 40 is received in the bottom open chamber 501 of the winding hub 50, having one end, namely, the inner end fastened to the tubular shaft 30 and the center rod 201 of the bottom cover shell 20 and the other end, namely, the outer end fastened to the periphery of the winding hub 50. The cables 60 are wound round the winding hub 50 in reversed directions and respectively extended out of the top cover shell 70. The top cover shell 70 has a center through hole 702, a plurality of beveled locating blocks 701 equiangularly spaced around the center through hole 702 for engaging the top locating holes 503 of the winding hub 50, and a plurality of positioning holes 702*a* equiangularly spaced around the center through hole 702. The button 80 has a stub center tube 801 inserted through the center through hole 702 of the top cover shell 70, a hooked portion 801*a* protruded from the periphery of the stub center tube 801 and hooked on the bottom wall of the top cover shell 70 to prohibit escape of the button 80 from the top cover shell 70, and a plurality of raised portions 802 equiangularly spaced around the stub center tube 801 and respectively engaged into the positioning holes 702*a* of the top cover shell 70.

Figure 4A:
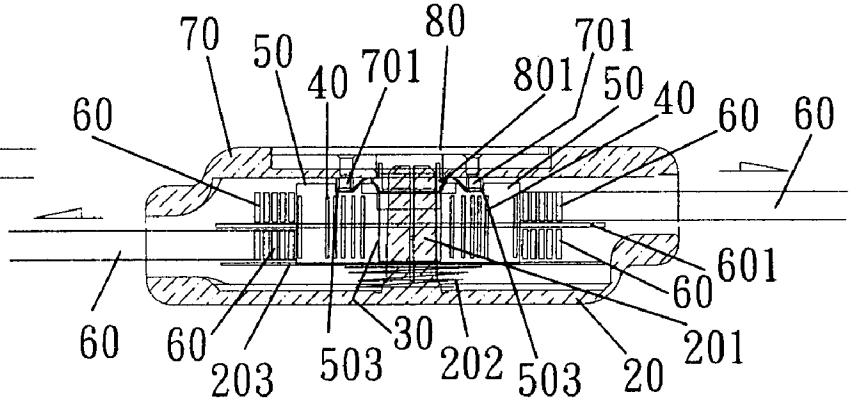
FIG. 4A is a schematic drawing showing the cable extending action of the cable reel according to the present invention.
Figure 5:
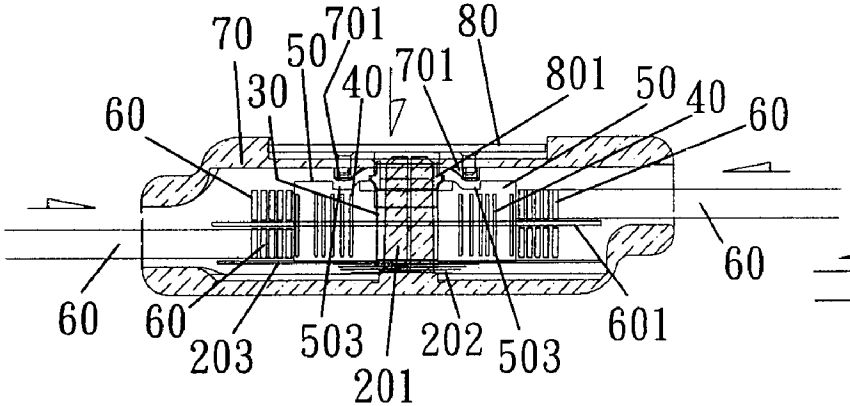
FIG. 5 is a schematic drawing showing the cable receiving action of the cable reel according to the present invention.

Referring to FIGS. 4, 4A and 5, when pulling the cables 60 out of the top cover shell 70 in reversed directions, the winding hub 50 is rotated on the center rod 201 of the bottom cover shell 20 to move the top locating holes 503 over the beveled locating blocks 701 for one way rotation. After the cables 60 have been extended to the desired length, stop pulling the cables 60, for enabling the beveled locating blocks 701 to engage the top locating holes 503 respectively to further stop the winding hub 50 from rotary motion relative to the top cover shell 70 (see FIGS. 4 and 4A). When wishing to receive the cables 60, press the button 80 to force the stub center tube 801 against the winding hub 50 and to further move the top locating holes 503 away from the beveled locating blocks 701, for enabling the spiral spring force of the spiral spring 40 to rotate the winding hub 50 on the center rod 201 of the bottom cover shell 20 in the reversed directions to receive the cables 60 (see FIG. 5).

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A cable reel comprising:

a bottom cover shell, said bottom cover shell comprising a center rod, a conical spring mounted on the center rod of said bottom cover shell, and a bearing plate supported on said conical spring;

a tubular shaft sleeved onto the center rod of said bottom cover shell and supported on said bearing plate against said conical spring;

a winding hub disposed over said bearing plate, said winding hub having a bottom open chamber which receives said tubular shaft, a center through hole rotationally mounted on the center rod of said bottom cover shell, a flange fastened to the periphery of one end thereof, and a plurality of top locating holes equiangularly spaced around the center through hole of said winding hub;

a spiral spring received in said bottom open chamber of said winding hub for biasing said winding hub to a cable winding angular position, said spiral spring having an inner end fastened to said tubular shaft and the center rod of said bottom cover shell and an outer end fastened to the periphery of said winding hub;

two cables wound round said winding hub in reversed directions for reversible extension responsive to rotation of said winding hub;

a top cover shell, said top cover shell having a center through hole, a plurality of beveled locating blocks equiangularly spaced around the center though hole of said top cover shell for engaging the top locating holes of said winding hub in releasably locked manner to limit rotation of said winding hub relative thereto to one direction, and a plurality of positioning holes equiangularly spaced around the center though hole of said top cover shell; and a button, said button having a stub center tube inserted though the center though hole of said top cover shell, a hooked portion protruded from the periphery of said stub center tube and hooked on a bottom wall of said top cover shell to prohibit escape of said button from said top cover shell, and a plurality of raised portions equiangularly spaced around said stub center tube and respectively engaged into the positioning holes of said top cover shell;

wherein when pulling said cables out of said top cover shell in reversed directions, said winding hub is rotated on the center rod of said bottom cover shell to move said top locating holes over said beveled locating blocks in said one direction of rotation against the angular bias of said spiral spring, and said beveled locating blocks are respectively engaged into said top locating holes of said winding hub to stop said winding hub from rotary motion in a reverse direction of rotation responsive to the bias of said spiral spring after said cables have been extended to the desired length and external pulling force has been released from said cables;

when pressing said button to force said stub center tube against said winding hub after said winding hub has been stopped against rotation to retain said cables relative to said top cover shell in an extended position, said winding hub being thereby displaced against the bias of said conical spring, whereby said top locating holes thereof are disengaged from said beveled locating blocks to free the spiral spring force of said spiral spring to rotate said winding hub on the center rod of said bottom cover shell in the reversed direction to the cable winding position.

* * * * *